US006742886B1

(12) United States Patent
Ray

(10) Patent No.: US 6,742,886 B1
(45) Date of Patent: Jun. 1, 2004

(54) INK JET COMPOSITIONS FOR LITHOGRAPHIC PRINTING

(75) Inventor: Joanne Ray, Fort Collins, CO (US)

(73) Assignee: Kodak Polychrome Graphics LLE, Norwalk, CT (US)

( * ) Notice: Subject to any disclaimer, the term of this patent is extended or adjusted under 35 U.S.C. 154(b) by 0 days.

(21) Appl. No.: 10/347,664

(22) Filed: Jan. 21, 2003

(51) Int. Cl.[7] ..... B41J 2/01; B41N 1/00

(52) U.S. Cl. ..... 347/100; 347/101; 101/457; 101/466

(58) Field of Search ..... 347/100, 101, 347/105, 95, 96; 101/457, 462, 466, 460

(56) References Cited

U.S. PATENT DOCUMENTS

| | | | | |
|---|---|---|---|---|
| 5,738,013 A | | 4/1998 | Kellett | 101/463.1 |
| 6,131,514 A | | 10/2000 | Simons | 101/466 |
| 6,283,589 B1 | * | 9/2001 | Gelbart | 347/101 |
| 6,341,560 B1 | | 1/2002 | Shah et al. | 101/463.1 |
| 6,352,811 B1 | | 3/2002 | Patel et al. | 430/270.1 |
| 6,352,812 B1 | | 3/2002 | Shimazu et al. | 430/273.1 |
| 6,358,669 B1 | | 3/2002 | Savariar-Hauck et al. | 430/273.1 |
| 6,359,056 B1 | | 3/2002 | Aurenty et al. | 524/556 |
| 6,471,349 B1 | | 10/2002 | Aurenty et al. | 347/100 |
| 6,520,086 B1 | * | 2/2003 | Newington et al. | 101/457 |

FOREIGN PATENT DOCUMENTS

| | | |
|---|---|---|
| EP | 1 120 247 | 8/2001 |
| EP | 1 157 825 | 11/2001 |
| EP | 1 157 826 | 11/2001 |
| EP | 1 157 827 | 11/2001 |
| EP | 1 157 828 | 11/2001 |
| EP | 1 211 063 | 5/2002 |
| WO | WO 00/37254 | 6/2000 |
| WO | WO 01/34394 | 5/2001 |
| WO | WO 01/49506 | 7/2001 |
| WO | WO 01/54915 | 8/2001 |

* cited by examiner

*Primary Examiner*—Stephen Meier
*Assistant Examiner*—Manish Shah
(74) *Attorney, Agent, or Firm*—Faegre & Benson LLP

(57) ABSTRACT

The present invention provides compositions and methods of ink jetting oleophilic images onto a substrate. The composition includes an oleophilic polymer having polar moieties that is soluble in an organic carrier and adheres to a substrate. Compositions of the present invention may be used to form oleophilic image areas for lithographic printing.

44 Claims, No Drawings

INK JET COMPOSITIONS FOR LITHOGRAPHIC PRINTING

BACKGROUND OF THE INVENTION

The art of lithographic printing is based on the immiscibility of ink and water. A lithographic printing plate is composed of ink receptive regions, commonly referred to as the "image area," generated on a hydrophilic surface of a substrate. When the surface of the printing plate is moistened with water and printing ink is applied, exposed portions of the hydrophilic surface retain the water and repel the printing ink, and the oleophilic image area accepts the printing ink and repels the water. The printing ink retained on the oleophilic image area may then be transferred to the surface of a material upon which the image is to be reproduced. Typically, the ink is first transferred to an intermediate blanket, which in turn transfers the ink to the desired surface.

One method for forming or generating an oleophilic image area on a substrate is by coating the substrate with a radiation-sensitive layer, and then exposing a portion of the layer to IR or UV radiation. The unexposed portion of the coated substrate (negative-working plates) or the exposed portion of the coated substrate (positive-working plates) then undergoes chemical development to form the oleophilic image area. One drawback to using printing plates incorporating this method of producing an oleophilic image area is that, after exposing the radiation-sensitive layer to radiation, the plates must be subjected to chemical processing (e.g., development in an alkaline solution) to form the image area.

An alternative method for forming an oleophilic image area on a substrate is by imagewise applying an ink jettable composition onto the substrate. Ink jetting of an oleophilic image area may be desirable because it requires no chemical processing prior to use. There are a variety of oleophilic materials suitable for ink jetting onto a substrate to form an oleophilic image area. Generally, these materials are soluble in either aqueous or organic carriers. For example, U.S. Pat. Nos. 6,359,056 and 6,131,514, and PCT Published Applications WO /0037254 and WO 01/34934 all report ink jettable materials that are soluble or form dispersions in aqueous solutions. However, for certain applications, it may be desirable to employ an oleophilic material that is soluble in an organic carrier.

SUMMARY OF THE INVENTION

In one embodiment, the present invention provides a method of preparing a printing plate. An ink jettable composition composed of an oleophilic polymer in substantially organic solvent is imagewise applied onto a substrate. The oleophilic polymer is then adhered to the substrate. Oleophilic polymers for use in this invention contain polar moieties, with the exception of nitrogen-containing heterocyclic moieties, and the moieties are essentially chemically unchanged when adhered to the substrate. Methods of adhering the oleophilic polymer include air or oven drying the printing plate and/or exposing the printing plate to UV light.

The oleophilic polymer used in the ink jettable composition of the present invention may be film-forming and adhere to the surface of the substrate to form an oleophilic image area. The oleophilic polymer generally contains polar moieties and is compatible with suitable organic solvents. Suitable oleophilic polymers include polyester resins, diazonium compounds, acrylic acid polymer derivatives, acetal resins, polyamide resins and phenolic resins. Suitable organic solvents include benzyl alcohol, 2-phenoxyethanol, diethyl ketone/methyl lactate/water, 1-methoxypropan-2-ol and ethyl-3-ethoxypropanol.

In another embodiment, the present invention provides a method of forming an image on a substrate. An ink jettable composition composed of an oleophilic polymer in substantially organic solvent is imagewise applied onto a substrate. The oleophilic polymer has polar moieties, with the exception of nitrogen-containing heterocyclic moieties.

In yet another embodiment, the present invention provides a lithographic printing plate composed of a substrate and an oleophilic image area. The oleophilic image area is composed of an oleophilic polymer and may contain other nonvolatile components or additives of the ink jettable composition. The oleophilic polymer includes polar moieties with the exception of nitrogen-containing heterocyclic moieties.

The ink jettable composition of the present invention has several characteristics beneficial for forming oleophilic image areas. First, the composition is suitably oleophilic to uptake ink to provide an inked image, but may readily transfer the inked image to a desired medium. Second, the composition forms a thin-film that adheres well to a variety of substrates to form a durable image area. Third, oleophilic image areas formed by the ink jettable composition of the present invention require no additional chemical processing prior to use.

DETAILED DESCRIPTION OF THE INVENTION

The present invention provides an ink jettable composition capable of forming oleophilic image areas on a substrate for use in a variety of printing plate applications. In one embodiment, an ink jettable composition according to the present invention includes an oleophilic polymer having polar moieties in a substantially organic solvent.

Suitable oleophilic polymers according to the present invention adhere effectively to a substrate and include polar moieties. In certain embodiments, the polymer may be composed of a polymeric backbone with one or more polar moieties. Suitable polar moieties may include carboxyl, hydroxyl, carbonyl, amine, amide, ammonium or sulfate groups. However, the polymer is free of nitrogen-containing heterocyclic moieties.

Examples of suitable polymers having polar moieties include derivatives of polyester resins, diazonium compounds, acrylic acid polymers, acetal resins, phenolic resins, polyamide resins and combinations thereof.

Suitable polyester resin derivatives include, for example, polyester acrylate, polyester resins having a phenolic hydroxyl group, and polyesters formed from p-hydroxybenzoic acid containing hydroxyl and carboxylate moieties. In one embodiment, the polyester resin is formed as a reaction product of diethyl-p-phenylenediacrylate and 1,4-bis(β-hydroxyethoxy)-cyclohexane, referred to hereinafter as Polymer A.

Other suitable resins include polymeric diazonium compounds or a mixture of polymeric diazonium compounds. A variety of these materials are known. These compounds may be prepared, for example, by condensation of monomers, such as monomers described in DE 2024244, with a condensation agent, such as formaldehyde, acetaldehyde, propionaldehyde, butyraldehyde, isobutyraldehyde or benzaldehyde. Furthermore, mixed condensation products may be used which, apart from the diazonium salt units, comprise other non-photosensitive units which are derived from condensable compounds, in particular from aromatic amines, phenols, phenol ethers, aromatic thioethers, aromatic hydrocarbons, aromatic heterocycles or organic acid amides.

Especially useful polymeric diazonium compounds are reaction products of diphenylamine-4-diazonium salts, optionally having a methoxy group in the phenyl group bearing the diazonium salt units, with formaldehyde or 4,4-bis-methoxy-methyl diphenyl ether. Dihydrogen phosphate, hexafluorophosphate, hexafluoroantimonate, hexafluoroarsenate, tetrafluoroborate, and aromatic sulfonates such as 4-tolyl-sulfonate or mesitylene sulfonate are particularly suitable counterions for these polymeric diazo resins.

In one embodiment, the diazonium compound is derived from the condensation of 3-methoxy-diphenylamine-4-diazonium sulfate and 4,4'-bis-methoxymethyldiphenylether isolated as the mesitylene sulfonate salt and is available under the tradename NEGA 107 from Panchim, Lisses, France.

Suitable acrylic acid polymer derivatives may include acrylic resins containing one or more monomers having an acidic group, for example polyhydroxystyrene, polyhalogenated hydroxystyrene, N-(4-hydroxyphenyl) methacrylamide, hydroquinone monomethacrylate, N-(sulfamoylphenyl)methacrylamide, N-phenylsulfonylmethacrylamide, N-phenylsulfonylmaleimide, acrylic acid, and methacrylic acid.

Examples of suitable phenolic resin derivatives include Novolak resins, resole resins, Novolak/resole resins and polyvinyl phenol resins. Novolak resins are polymers that are derived by the polycondensation of at least one kind of aromatic compound such as phenol, m-cresol, p-cresol, 2,5-xylenol, 3,5-xylenol, resorcin, pyrogallol, bisphenol A, trisphenol, o-ethylphenol, m-ethylphenol, p-ethylphenol, propyl phenol, n-butylphenol, t-butylphenol, 1 -napthol and 2-napthol, with at least one aldehyde such as formaldehyde, acetaldehyde, propionaldehyde, benzaldehyde, fufuralor, or ketones such as acetone, methyl ethyl ketone and methyl isobutyl ketone and other aldehyde-releasing compounds capable of undergoing phenol-aldehyde condensation in the presence of an acid catalyst. Typical Novolak resins include, but are not limited to, phenol-formaldehyde resin, cresol-formaldehyde resin, phenol-cresol-formaldehyde resin, p-t-butylphenol-formaldehyde resin, and pyrogallol-acetone resins.

Resole resins are formed as the condensation product of bis-phenol A and formaldehyde. Examples of suitable resole resins include R17620, a phenol/formaldehyde resole resin sold by B.P. Chemicals Ltd. of Sully, Wales, SMD995, an alkyl phenol/formaldehyde resole resin sold by Schnectady Midland Ltd. of Wolverhampton, England, UCAR phenolic resin BKS-5928 from Georgia Pacific Corporation and Uravar FN6, an alkyl phenolic resole resin sold by DSM Resins UK, South Wirral, UK.

Suitable polyvinyl compounds may be synthesized by radical polymerization or cationic polymerization of one or more hydroxystyrene derivatives. The polyvinyl phenol may be at least partially hydrogenated. It may also be composed of a resin in which OH groups of the phenols are protected with a t-butoxycarbonyl group, a pyranyl group, or a furanyl group. Suitable polyvinyl phenols include polyhydroxystyrenes and copolymers containing recurring units of a hydroxystyrene, and polymers and copolymers containing recurring units of halogenated hydroxystyrenes. Specific examples of suitable polyvinyl phenol compounds include o-hydroxystyrene, m-hydroxystyrene, p-hydroxystyrene, 2-(o-hydroxyphenyl)propylene, 2-(m-hydroxyphenyl) propylene and 2-(p-hydroxyphenyl)propylene.

Examples of suitable acetal resins may include polyvinyl acetal resin, formal resin and butyral resin. One example of an acetal resin is a binary acetal polymer that is composed of recurring units which include two six-member cyclic acetal groups, one of which is unsubstituted or substituted with an alkyl or hydroxyalkyl group and the other of which is substituted with an aromatic or heterocyclic moiety as disclosed in U.S. Pat. No. 5,169,897. Another example is an acid-substituted ternary acetal polymer composed of recurring units which include three six-member cyclic acetal groups, one of which is unsubstituted or substituted with an alkyl or hydroxyalkyl group, another of which is substituted with an aromatic or heterocyclic moiety, and a third of which is substituted with an acid group, an acid-substituted alkyl group or an acid-substituted aryl group as disclosed in U.S. Pat. No. 5,219,699. Yet another example of an acetal polymer is reported in U.S. Pat. No. 5,534,381. A further example is a polyvinyl acetal resin which contains 4 to 40 mol-% vinyl alcohol units, 1 to 20 mol-% vinyl acetate units, 0 to 85 mol-% vinyl acetal units derived from an aldehyde free of hydroxyl groups and 1 to 85 mol-% vinyl acetal units derived from an aldehyde containing hydroxyl groups as described in U.S. Pat. No. 4,940,646. In one embodiment, the acetal resin is derived from polyvinyl alcohol in which 19.5 mol percent of the hydroxyl groups are functionalized with acetaldehyde, 45.6 mol percent of the hydroxyl groups are functionalized with butyraldehyde, 10.3 mol percent of the hydroxyl groups are functionalized with 4-carboxybenzaldehyde, 1.5 mol percent of the hydroxyl groups are functionalized with ethanoic acid and 23.1 mol percent of the hydroxyl groups are unfunctionalized, referred to hereinafter as Polymer B.

Examples of suitable polyamide resins include sulfonamide monomers and methacrylamide monomers. Other suitable copolymers may include between 10 to 90 mol % of a sulfonamide monomer unit, such as N-(p-aminosulfonylphenyl)methacrylamide, N-(m-aminosulfonylphenyl)methacrylamide, N-(o-aminosulfonylphenyl)methacrylamide, and/or the corresponding acrylamide. Useful alkaline developer soluble polymeric materials that comprise a pendent sulfonamide group and their method of preparation are disclosed in U.S. Pat. No. 5,141,838, incorporated herein by reference.

The oleophilic polymers described above may be soluble in substantially organic solvents, while being insoluble in predominantly aqueous solutions. Suitable organic solvents will depend on the specific oleophilic polymer being used, and generally include alcohols, ketones, and aliphatic and aromatic hydrocarbons. For example, the solvent may include benzyl alcohol, 2-phenoxyethanol, diethyl ketone/methyl lactate/water or 1-methoxypropan-2-ol. Other suitable solvents may include dimethyl formamide, tetrahydrofuran, methyl cellosolve, n-hexane, cyclohexane, trichloroethane, carbon tetrachloride, toluene, ethyl acetate, trichloroethylene, methyl ethyl ketone, methyl acetate, cyclohexanone, dioxane, acetone, carbon disulfide, nitrobenzene, nitromethane, ethanol, dimethyl sulfoxide, ethylene carbonate, phenol, methanol and ethyl-3-ethoxy propanol. As described in further detail below, these solvents may be at least partially dried or evaporated after imagewise applying the composition onto the substrate.

Optionally, the composition of the present invention may include or further comprise nonvolatile components or additives commonly used in inkjet fluid compositions. For example, the composition may include a variety of surfactants, humectants, biocides, viscosity builders, colorants, dyes, pH adjusters, drying agents, defoamers and combinations thereof. Examples of suitable surfactants include ZONYL surfactant supplied by Dupont, SURFYNOL surfactant supplied by Air Products and AEROSOL surfactant supplied by Cyanamid. An example of a suitable humectant is ethandiol. Suitable biocides include PROXEL GXL supplied by Zeneca Colors and KATHON XL supplied by Rohm and Haas. An example of a suitable viscosity builder is polyethylene glycol. The composition may also include dyes such as Ethyl Violet, Crystal Violet, Malachite Green, Brilliant Green, Victoria Blue B, Victoria Blue R and Victoria Pure Blue BO.

The ink jettable composition of the present invention may be applied to a substrate to form an oleophilic image area suitable for use in printing plate applications. Suitable substrates have hydrophilic surfaces, and generally include metals, polymeric films, ceramics, stiff papers, or a laminate of these materials. Suitable metal substrates include aluminum, zinc, titanium and alloys thereof. Suitable polymeric supports, such as polyethylene terephthalate film, may be coated with hydrophilicity-enhancing components, including alkoxysilanes, aminopropyltriethoxysilane, glycidoxypropyltriethoxysilane and epoxy functional polymers. The substrate may be of sufficient thickness to sustain the wear from printing and be thin enough to wrap around a printing form. Typical substrate thickness ranges from about 100 to about 600 $\mu$m. Adhesion of the oleophilic polymer may be increased by treating the surface of the substrate prior to application of the oleophilic polymer. For example, the surface of an aluminum substrate may be treated by anodizing and/or graining to promote adhesion of the oleophilic polymer. Specific examples of suitable substrates and substrate treatments are provided in Table 1 below.

TABLE 1

| SUBSTRATE | SURFACE TREATMENT | INTERLAYER TREATMENT |
|---|---|---|
| AA | Quartz Grained and Anodized | None |
| EG-PVPA | Electrograined and Anodized | Polyvinyl phosphoric acid |
| PF | Electrograined and Anodized | Sodium dihydrogen phosphate/Sodium fluoride |
| G20 | Electrograined and Anodized | Vinylphosphonic acid/acrylamide copolymer |
| EG-Sil | Electrograined and Anodized | Sodium Silicate |
| DS-Sil | Chemically Grained and Anodized | Sodium Silicate |
| PG-Sil | Pumice Grained and Anodized | Sodium Silicate |
| CHB-Sil | Chemically Grained, Anodized and Silicated | Sodium Silicate |

In Table 1 above, the abbreviation "AA" refers to "as anodized." An aluminum surface is quartz grained and then anodized using DC current of about 8 A/cm$^2$ for 30 seconds in a $H_2SO_4$ solution (280 g/liter) at 30° C.

"EG" means "electrolytic graining." The aluminum surface is first degreased, etched and subjected to a desmut step (removal of reaction products of aluminum and the etchant). The plate is then electrolytically grained using an AC current of 30–60 A/cm$^2$ in a HCl solution (10 g/liter) for 30 seconds at 25° C., followed by a post-etching alkaline wash and a desmut step. The grained plate is then anodized using DC current of about 8 A/cm$^2$ for 30 seconds in a $H_2SO_4$ solution (280 g/liter) at 30° C.

"PVPA" is a polyvinylphosphonic acid. A plate is immersed in a PVPA solution and then washed with deionized water and dried at room temperature.

"PF" means that the substrate has a phosphate fluoride interlayer. The process solution contains sodium dihydrogen phosphate and sodium fluoride. An anodized substrate is treated in the solution at 70° C. for a dwell time of 60 seconds, followed by a water rinse and drying. The sodium dihydrogen phosphate and sodium fluoride are deposited as a layer to provide a surface coverage of about 500 mg/M$^2$.

"G20" is a printing plate substrate described in U.S. Pat. No. 5,368,974, which is incorporated herein by reference.

"Sil" means that an anodized plate is immersed in a sodium silicate solution to coat it with an interlayer. The coated plate is then rinsed with deionized water and dried at room temperature.

"DS" means "double sided smooth." As aluminum oxide plate is degreased, etched or chemically grained, and subjected to a desmut step. The smooth plate is then anodized.

"PG" means "pumice grained." The surface of an aluminum substrate is degreased, etched and subjected to a desmut step. The plate is then mechanically grained by subjecting it to a 30% pumice slurry at 30° C., followed by a post-etching step and desmut step. The grained plate is then anodized using DC current of about 8 A/cm$^2$ for 30 seconds in a $H_2SO_4$ solution (280 g/liter) at 30° C. The anodized plate is then coated with an interlayer of, for example, sodium silicate.

"CHB" means chemical graining in a basic solution. After an aluminum substrate is subjected to a matte finishing process, a solution of 50 to 100 g/liter NaOH is used during graining at 50° C. to 70 ° C. for 1 minute. The grained plate is then anodized using DC current of about 8 A/cm$^2$ for 30 seconds in a $H_2SO_4$ solution (280 g/liter) at 30° C. The anodized plate is then coated with a silicated interlayer.

Optionally, prior to application of the ink jettable composition, a surfactant may be applied to the substrate to form a printing plate precursor. The surfactant may improve printing plate image resolution without adversely affecting the adhesion of the ink jettable composition. Suitable surfactants for the present invention include alkylated surfactants, fluorosurfactants and siliconated surfactants.

Suitable alkylated surfactants include sodium dodecylsulfate, isopropylamine salts of an alkylarylsulfonate, sodium dioctyl succinate, sodium methyl cocoyl taurate, dodecylbenzene sulfonate, alkyl ether phosphoric acid, N-dodecylamine, dicocoamine, 1 -aminoethyl-2-alkylimidazoline, 1-hydroxyethyl-2-alkylimidazoline, cocoalkyl trimethyl quaternary ammonium chloride, polyethylene tricecyl ether phosphate and the like.

Examples of suitable fluorosurfactants include ZONYL FSD, ZONYL FSA, ZONYL FSP, ZONYL FSJ, ZONYL FS-62, ZONYL FSK, ZONYL FSO and ZONYL FS-300, all of which are commercially available from E.I. Du Pont De Nemours & Co. Additional examples of suitable fluorosurfactants include FLUORAD FC-135, FLUORAD FC-129, FLUORAD FC-120, FLUORAD FC-100, FLUORAD FC-170C and FLUORAD FC-171, all of which are commercially available from 3M, St. Paul, Minn.

Examples of suitable siliconated surfactants include polyether modified poly-dimethyl-siloxane, silicone glycol, polyether modified dimethyl-polysiloxane copolymer, and polyether-polyester modified hydroxy functional polydimethyl-siloxane.

The precursor plate surfactant may be adsorbed onto the substrate by any conventional method, for example, by immersion of the substrate in an aqueous solution of the surfactant for a suitable period of time. The remaining non-adsorbed surfactant may then be removed from the substrate surface by, for example, rinsing with water, and then drying. The resulting printing plate precursor has an effective amount of surfactant on at least one surface of the substrate to improve printing resolution.

The composition of the present invention may be applied or ink jetted onto the substrate or the printing plate precursor by conventional ink jetting methods to form an oleophilic image region suitable for use in a printing plate. Examples of suitable ink jet printers for use with the compositions of the present invention include the Xaarjet Evaluation Kit, Model No. XJ126R supplied by Xaarjet, Cambridge, UK, the Hewlett Packard DeskJet 970 CXI ink jet printer, the Hewlett Packard 540C ink jet printer, the Epson Stylus Color 600 ink jet printer, the Epson 740 ink jet printer, the Epson 800 ink jet printer, the Epson Stylus Color 900 ink jet printer and the Epson Stylus Color 3000 ink jet printer.

After imagewise applying the composition to the substrate by ink jetting, the oleophilic polymer may be adhered to the substrate. The attractive forces of the polar moieties contained in the polymer may facilitate or enhance the adhesion of the oleophilic polymer to the substrate. The oleophilic polymer may be adhered, for example, by drying the plate or exposing the plate to UV radiation. Suitable drying techniques include air drying and/or oven drying.

In one embodiment, the oleophilic polymer may be adhered to the substrate by drying the plate in a suitable oven at between about 50 and 200° C. for between about 30 seconds and five minutes. In another embodiment, the plate may be dried at about 100° C. for about one minute.

Alternatively, the oleophilic polymer may be adhered to the substrate by exposing the plate to UV radiation to cure the polymer. In one embodiment, the plate may be exposed to UV radiation provided by one or more 1000 to 5000 Watt multi-spectrum diazonium/photopolymer lamps for at least 10 seconds, more particularly, between 10 seconds and 120 seconds to cure the polymer.

In yet another embodiment, the plate may be oven dried and then exposed to UV radiation. For example, the plate may be oven dried at about 100° C. for about 1 minute and then exposed to UV energy for about 25 seconds to cure the composition. The oven drying and curing steps, although optional, may provide improved press durability in certain embodiments.

The adhered oleophilic image area may retain between about 0 w/w percent and 90 w/w percent of the organic solvent after air drying, oven drying and/or UV exposure steps depending on the particular polymer and solvent used. For example, air dried polymeric solutions containing 2-phenoxyethanol exhibited a residual solvent level of about 90 w/w percent, while oven dried polymeric solutions containing the same solvent exhibited a residual solvent level of about 5 w/w percent. In another example, air dried solutions containing acetone exhibited a residual solvent level of about 15 w/w percent, while oven dried solutions containing the same solvent exhibited a residual solvent level of about 14 w/w percent.

The oleophilic image area of the present invention may be a film having a thickness between about 1 and 5 mil, more particularly between about 1 and 2 mil. The oleophilic image area is sufficiently ink-receptive to uptake ink, but may readily transfer the ink to an intermediate blanket or other desired destination. Furthermore, as described in the examples below, embodiments of the present invention demonstrate suitable durability for extended run length without additional processing.

The invention may be further characterized by the following examples:

EXAMPLE 1

The polymeric materials listed in Table 2 below were each dissolved in a substantially organic solvent. The resulting solutions were then evaluated over a 24 hour period to determine the compatibility and stability of the solutions. The compatibility and stability of the solutions serve as an indication of the suitability of a particular solution for ink jet application to a substrate.

Next, the solutions containing Polymer A and NEGA 107, were each decanted into a syringe system that supplies a Xaarjet ink jet device, Model XJ126R, supplied by Xaarjet, Cambridge, UK. The Xaarjet device includes a PC-controlled imaging output device, an imaging device and a signal encoder that controls the imaging head. The movement of the platten, which supports the substrate to be imaged, activates the imaging head. The fire frequency was set at 5 Hz with an external trigger, and the image control was set at "External SE." The head was primed prior to imaging to ensure that the presence of the composition was continuous throughout the imaging head.

A sample of electrograined and anodized aluminum was placed on the platten, which was then moved to initiate the imaging mechanism. After passing under the imaging head, a clear and accurate copy of the desired image was formed.

In lieu of the ink jetting process described above, the solutions containing Polymer B, Novolak N13 and Polymer A/Ethyl Violet were applied to a sample of anodized and electrograined aluminum using a cotton-tipped applicator swab. As previously noted, the ink jet suitability of these solutions was determined by analyzing the compatibility and stability of the solution over a 24 hour period.

As described in Table 2, certain samples were then air dried and evaluated on an AB Dick duplicator press supplied by AB Dick, Niles, Ill. The press was set up with Van Son Rubberbase ink, Varn 142W fountain solution at a concentration of 3 oz per gallon and Varn PAR alcohol replacement at a concentration of 3 oz per gallon. The plate was then placed onto the duplicator press and tested to determine whether the image area could uptake ink and readily transfer the inked image to paper.

In lieu of air drying, other samples were oven dried at 100° C. for 60 seconds and/or UV cured for 25 seconds. Also, Prisco LPC was applied to certain samples after initial impressions were taken to test image durability. Prisco LPC, supplied by Printer's Services, Newark, N.J., is an aggressive plate cleaner used to desensitize background scratches and to reduce tinting.

Table 2 summarizes a series of tests conducted substantially as described above. The variable "I" represents the number of impressions the plate produced when the test was suspended (prior to plate failure). The term "washed" refers to the number of impressions the plate produced after the application of Prisco LPC.

TABLE 2

| POLYMER | AIR DRIED | OVEN DRIED | UV CURED | OVEN DRIED & UV CURED |
|---|---|---|---|---|
| Polymer A | I = 50 Washed: I = 0 | I = 50 Washed: I = 50 | I = 50 Washed: I = 50 | I = 50 Washed: I = 50 |
| NEGA 107 | I = 50 Washed: I = 0 | I = 50 Washed: I = 0 | I = 50 Washed: I = 50 weakened images | I = 50 Washed: I = 50 |
| Polymer B Washed: I = 0 | I = 250 Washed: I = 50 | I = 250 Washed: I = 0 weakened images | I = 250 Washed: I = 50 | I = 250 weakened images |
| Novolak N13 | I = 250 Washed: I = 50 | N/A | N/A | N/A |
| Polymer A & Ethyl Violet | N/A | I = 250 Washed: I = 50 | N/A | N/A |

The polymers described in Table 2 were prepared as follows:

Polymer A

Polymer A is a polyester resin formed as the reaction product of diethyl-p-phenylenediacrylate and 1 ,4-bis(β-hydroxyethoxy)-cyclohexane. The polyester resin (5 g) was dissolved in benzyl alcohol (95 g).

NEGA 107

NEGA 107 is a diazo resin derived from the condensation of 3-methoxy-diphenylamine-4-diazonium sulfate and 4,4'-bis-methoxymethyldiphenylether isolated as the mesitylene sulfonate salt as supplied by Panchim, Lisses, France. The diazonium compound (2 g) was dissolved in 2-phenoxyethanol (98 g).

Polymer B

Polymer B is a polymeric acetal resin derived from polyvinyl alcohol, in which 19.5 mol percent of the hydroxyl groups are functionalized with acetaldehyde, 45.6 mol percent of the hydroxyl groups are functionalized with butyraldehyde, 10.3 mol percent of the hydroxyl groups are functionalized with 4-carboxybenzaldehyde, 1.5 mol percent of the hydroxyl groups are functionalized with ethanoic acid and 23.1 mol percent of the hydroxyl groups are unfunctionalized.

The resin (2 g) was dissolved in 1-methoxypropan-2-ol (98 g). The resulting solution was applied to a sample of electrograined and anodized aluminum using a cotton-tipped applicator swab.

Novolak N13

Novolak N13 is supplied by Eastman Kodak Company as a 34 percent solution in acetone. In lieu of ink jetting, the resin as supplied was applied to a sample of electrograined and anodized aluminum using a cotton-tipped applicator swab.

Polymer A & Ethyl Violet

Polymer A (5 g) and Ethyl Violet (5 g) as supplied by Aldrich, Milwaukee, Wis., were dissolved in benzyl alcohol (94.5 g). In lieu of ink jetting, the resulting solution was applied to a sample of electrograined and anodized aluminum using a cotton-tipped applicator swab.

As demonstrated by the results summarized in Table 2, oleophilic image areas produced according to the present invention were able to uptake ink and to produce multiple impressions of the image areas. Furthermore, many of the embodiments summarized in Table 2 were able to endure application of an aggressive wash and still uptake and transfer ink. These tests indicate that embodiments of the present invention possess suitable oleophilic and plate durability characteristics for use as lithographic printing plates.

Although the present invention has been described with reference to particular embodiments and examples, workers skilled in the art will recognize that changes may be made in form and detail without departing from the spirit and scope of the invention. In addition, the invention described herein is not to be taken as limited to all of the details thereof as modifications and variations thereof may be made without departing from the spirit or scope of the invention.

What is claimed is:

1. A method of preparing a printing plate comprising:

providing a substrate; and imagewise applying onto the substrate an ink jettable composition consisting essentially of an oleophilic polymer in a substantially organic solvent and optional nonvolatile components or additives, wherein the oleophilic polymer has polar moieties with the exception of nitrogen-containing heterocyclic moieties; and adhering the oleophilic polymer to the substrate.

2. The method of claim 1 wherein adhering the polymer comprises drying the plate.

3. The method of claim 2 wherein drying the plate comprises air drying the plate.

4. The method of claim 2 wherein drying the plate comprises oven drying the plate at between about 50 and 200° C.

5. The method of claim 2 wherein drying the plate comprises oven drying the plate at about 100° C.

6. The method of claim 2 wherein drying the plate comprises oven drying the plate for between about 0.5 and 5 minutes.

7. The method of claim 2 wherein drying the plate comprises oven drying the plate for about 1 minute.

8. The method of claim 2 wherein drying the plate comprises oven drying the plate at about 100° C. for about 1 minute.

9. The method of claim 1 wherein adhering the polymer comprises exposing the plate to UV energy.

10. The method of claim 9 wherein exposing the plate to UV energy comprises exposing the plate to UV energy provided by 1000 to 5000 Watt lamps.

11. The method of claim 9 wherein exposing the plate to UV energy comprises exposing the plate to UV energy for at least about 10 seconds.

12. The method of claim 11 wherein exposing the plate to UV energy comprises exposing the plate to UV energy for between about 10 and 60 seconds.

13. The method of claim 11 wherein exposing the plate to UV energy comprises exposing the plate to UV energy for about 25 seconds.

14. The method of claim 1 wherein adhering the polymer comprises oven drying the plate and exposing the plate to UV energy.

15. The method of claim 14 wherein adhering the polymer comprises oven drying the plate at about 100° C. for about 1 minute and exposing the plate to UV energy for about 25 seconds.

16. The method of claim 1 wherein the polar moieties comprise carboxyl, hydroxyl, carbonyl, amine, ammonium, sulfate or amide moieties.

17. The method of claim 1 wherein the polymer comprises a polyester resin derivative.

18. The method of claim 1 wherein the polymer comprises a diazonium compound.

19. The method of claim 1 wherein the polymer comprises an acrylic acid polymer derivative.

20. The method of claim 1 wherein the polymer comprises an acetal resin derivative.

21. The method of claim 1 wherein the polymer comprises a polyamide resin derivative.

22. The method of claim 1 wherein the polymer comprises a phenolic resin derivative.

23. The method of claim 22 wherein the phenolic resin derivative comprises a Novolak resin, a resole resin or a polyvinyl phenol resin.

24. The method of claim 1 wherein the substantially organic solvent comprises an alcohol, a ketone, an aliphatic hydrocarbon or an aromatic hydrocarbon.

25. The method of claim 1 wherein the substantially organic solvent comprises dimethyl formamide, tetrahydrofuran, methyl cellosolve, n-hexane, cyclohexane, trichloroethane, carbon tetrachloride, toluene, ethyl acetate, trichloroethylene, methyl ethyl ketone, methyl acetate, cyclohexanone, dioxane, acetone, carbon disulfide, nitrobenzene, nitromethane, ethanol, dimethyl sulfoxide, ethylene carbonate, phenol or methanol.

26. The method of claim 1 wherein the substantially organic solvent comprises benzyl alcohol, 2-phenoxyethanol, diethyl ketone/methyl lactate/water, 1-methoxypropan-2-ol or ethyl-3-ethoxypropanol.

27. The method of claim 1 wherein the composition includes between about 1 and 40 w/w percent of the oleophilic polymer.

28. The method of claim 1 wherein the optional nonvolatile components or additives comprise surfactants, humectants, colorants, dyes, viscosity builders, pH adjusters, drying agents, defoamers or combinations thereof.

29. The method of claim 28 wherein the optional nonvolatile components or additives include Ethyl Violet, Crystal Violet, Malachite Green, Brilliant Green, Victoria Blue B, Victoria Blue R or Victoria Pure Blue BO.

30. A method of forming an image on a substrate comprising:

providing a substrate; and imagewise applying to the substrate an ink jettable composition consisting essentially of an oleophilic polymer having polar moieties in a substantially organic solvent and optional nonvolatile components or additives, wherein the oleophilic polymer is free of nitrogen-containing heterocyclic moieties.

31. The method of claim 30 further comprising adhering the polymer onto the substrate.

32. The method of claim 30 wherein adhering the polymer comprises drying the image.

33. The method of claim 30 wherein adhering the polymer comprises oven drying the image.

34. The method of claim 30 wherein adhering the polymer comprises exposing the image to UV energy.

35. The method of claim 30 wherein adhering the polymer comprises oven drying the image and exposing the image to UV energy.

36. A printing plate formed by the method of claim 30.

37. A printing plate comprising:

a substrate; and an oleophilic image area adhered to the substrate, wherein the oleophilic image area consists essentially of an ink jettable oleophilic polymer and optional nonvolatile components or additives, wherein the oleophilic polymer has polar moieties with the exception of nitrogen-containing heterocyclic moieties.

38. The printing plate of claim 37 wherein the substrate comprises a metal.

39. The printing plate of claim 38 wherein the metal comprises aluminum.

40. The printing plate of claim 39 wherein the aluminum comprises grained and anodized aluminum.

41. The printing plate of claim 37 wherein the image areas are adhered to the substrate by drying the plate.

42. The printing plate of claim 37 wherein the image areas are adhered to the substrate by exposing the plate to UV radiation.

43. The printing plate of claim 37 wherein the image area further consists essentially of between 0 v/v percent and 90 v/v percent substantially organic solvent.

44. The printing plate of claim 37 wherein the image area further consists of between 0 v/v percent and 25 v/v percent substantially organic solvent.

* * * * *